US005574245A

United States Patent [19]

Buc et al.

[11] Patent Number: 5,574,245

[45] Date of Patent: Nov. 12, 1996

[54] FRAGMENT-SEALING BULLET TRAP

[76] Inventors: Steven M. Buc, 53 Lake Park Ct., Germantown, Md. 20874; Stephen Adelman, 10011 Maxwell Ct., Manassas, Va. 22110

[21] Appl. No.: 600,520

[22] Filed: Feb. 13, 1996

[51] Int. Cl.[6] ..... F42B 30/06

[52] U.S. Cl. ..... 102/485; 42/105

[58] Field of Search ..... 102/483–485; 42/105

[56] References Cited

U.S. PATENT DOCUMENTS

| | | | |
|---|---|---|---|
| 2,853,003 | 9/1958 | Bowles | 102/485 |
| 3,664,263 | 5/1972 | Driscoll | 102/65.2 |
| 3,726,036 | 4/1973 | Jennings et al. | 42/1 F |
| 4,394,836 | 7/1983 | Chavee et al. | 102/485 |
| 4,567,831 | 2/1986 | Gordon et al. | 102/485 |
| 4,747,349 | 5/1988 | Schilling et al. | 102/485 |
| 5,349,906 | 9/1994 | Devaux et al. | 102/485 |
| 5,448,937 | 9/1995 | Buc et al. | 89/1.34 |

FOREIGN PATENT DOCUMENTS

| | | | |
|---|---|---|---|
| 2517424 | 6/1983 | France | 102/485 |
| 2517820 | 6/1983 | France | 102/485 |
| 2109513 | 6/1983 | United Kingdom | 102/485 |
| 2223833 | 4/1990 | United Kingdom | 102/485 |

*Primary Examiner*—Harold Tudor

[57] ABSTRACT

A fragment-sealing bullet trap for rifle muzzle launched projectiles having a soft aluminum plug for decelerating and absorbing the softer components of rifle bullets, followed by a shock absorbing piston to mitigate the peak acceleration of the projectile due to bullet impact, in turn followed by a hardened steel anvil to safely capture any steel bullet components. Attached to the aft portion of the plug is an aluminum cap, containing a rubber gasket, which expands during bullet penetration, but rebounds due to its resiliency, tightly sealing off the bullet trap against the escape of bullet and plug fragments. The cap is designed to prevent the gasket from blowing out as a result of high bullet trap pressurization.

20 Claims, 3 Drawing Sheets

FRAGMENT-SEALING BULLET TRAP

BACKGROUND OF THE INVENTION

1. Field of the Invention

The invention relates to bullet traps, and more specifically to bullet traps employed in rifle muzzle launched projectiles, which contain therein a tube for sliding the projectile over the muzzle of the rifle to retain the muzzle gas pressure, thus providing a means of propulsion; and within the tube a soft, low strength metallic plug to decelerate and retain the soft metallic components of rifle bullets; a hard, high strength metallic anvil to stop and retain the hard, high strength metallic components of rifle bullets; a shock absorbing piston to reduce the peak launch acceleration due to bullet impact; and a cap attached to the soft metallic plug, containing therein a resilient gasket to seal the bullet trap against the escape of rifle bullet and bullet trap fragments, thus providing greater safety to the operator.

2. Description of the Prior Art

The concept of launching a projectile, such as a grenade or line throwing device, from the muzzle of a rifle has existed for many decades, and offers advantages in terms of range and accuracy over hand-thrown counterparts. Such muzzle launched projectile systems commonly employ one of three bullet trap - rifle cartridge combinations. The first and most simple of these systems employs a blank propellant cartridge, fired into the projectile tube. Blank propellant cartridges can be designed to provide significant muzzle pressures, sufficient to launch the projectile with adequate velocity to a useful range, without the need to incorporate an expensive and heavy bullet stopping device within the projectile tube.

This concept of providing the soldier with sufficient blank propellant cartridges to launch rifle grenades had been satisfactory for many years. However, the growing need of modern armies to streamline logistics and reduce the weight burden on infantrymen eventually resulted in blank propellant cartridges becoming largely unavailable. To satisfy the continuing need to launch rifle grenades and line throwing projectiles without the availability of blank cartridges, two classes of bullet traps were developed, which safely operate when standard rifle ammunition is fired into the projectile tube.

The first type of bullet trap employs a soft metallic plug, such as aluminum, which is capable of decelerating and absorbing the impact of standard soft-core rifle bullets. Soft-core rifle bullets typically employ a soft lead-antimony filler within a ductile copper alloy bullet jacket. These bullet components deform and expand upon impact with an aluminum bullet trap plug. The aluminum plug has sufficient strength and ductility to retain the bullet, without fracturing the launch tube, thus allowing the safe launching of the projectile from the rifle.

In recent years, steel bullet cores have begun to replace portions of the soft lead bullet filler found in standard rifle ammunition, with the intent to improve some aspect of terminal effectiveness. Sometimes these steel cores are hardened to provide armor piercing capability. When these types of steel-core bullets are fired into soft aluminum bullet trap plugs, the steel core traverses the plug intact, and can cause catastrophic failure of the rifle grenade, and serious injury, if not death to the operator.

To improve the safety of these types of bullet traps with respect to steel-core bullets, a hardened steel anvil is typically placed directly following the softer aluminum plug. In this manner, the steel core is still retained, and the grenade safely launched from the rifle. The hardened steel anvil is not designed to replace the soft aluminum plug, however. The anvil serves to complement its effectiveness. If a steel anvil or steel plug was used alone, the impacting bullet would splatter, sending shards of bullet fragments in all directions, piercing the launch tube, with catastrophic results.

In addition to the use of steel anvils in bullet traps, interest developed in reducing the shock acceleration loads to which the projectile was subjected during launch. High launch acceleration loads can result in deformation and damage to the projectile payload. When a rifle bullet impacts a plug of aluminum, launch accelerations can exceed 30,000 times that of gravity. Many payload structures cannot withstand this level of acceleration loading. This bullet impact acceleration contrasts with the relatively minor peak acceleration generated from a blank propellant cartridge, approximately 5,000 g's.

To overcome these high bullet impact accelerations, bullet traps began to incorporate shock absorbing pistons. This piston can be a simple cylindrical section of aluminum, supported within the launch tube following the bullet trap, and which will crush and deform when the acceleration forces exceed the rupture strength of the material cross-section. By designing a relatively long and thin aluminum piston, peak accelerations may be reduced to under 10,000 g's.

Unfortunately, as a result of adding these steel anvils and shock absorbing pistons, bullet traps become heavier and longer. This added weight and depth to the bullet trap can greatly affect projectile performance. A longer bullet trap reduces the internal length of the projectile tube, which can be placed over the rifle muzzle, thus reducing the launch velocity. A lower launch velocity then results in less flight range of the projectile. The following explanation describes these tradeoffs.

When a bullet is fired into the projectile tube, the tube pressurizes with the cartridge gases from the rifle. These gases then begin to push the projectile off of the rifle muzzle. This entrapped gas pressure is the primary means of propulsion. Analysis and testing shows that the momentum of the bullet adds less than 12% to the launch velocity of the projectile. The greater the length of tube over the muzzle, therefore, the longer the pressure acts to accelerate the projectile. Therefore, to achieve equivalent launch velocity, with a longer bullet trap, the overall length of the projectile tube must be increased. This increase in tube length again increases the total projectile weight. Along with the added weight of the anvil, the total weight of the projectile can increase significantly. As the projectile total weight increases, the launch velocity decreases proportionally, since there is a fixed quantity of momentum in the rifle cartridge. As a result, overall system performance is again reduced.

To limit this cycle of increased weight and reduced launch velocity, due to the need to retain steel-core bullets within the projectile launch tube, a third class of bullet trap was developed. This type is called the bullet-through, and is exemplified in U.S. Pat. No. 4,394,836 (Chavee et al.). This type of bullet trap simply employs a resilient rubber gasket supported within the launch tube, which permits the bullet to traverse the entire length of the projectile, and exit from the front, while the cartridge gas pressure is retained within the tube behind the self-sealing gasket. The bullet-through approach, however, assumes that the payload can accommodate a through-hole up front, so that the bullet may exit.

In spite of the development of the bullet-through class of bullet traps, there exists a continuing need for actual bullet traps employing soft metallic plugs, followed by hardened metallic anvils. Some muzzle launched projectiles cannot be efficiently adapted to the bullet-through approach, such as the muzzle launched grapnel hook, U.S. Pat. No. 5,448,937 (Buc et al.). For these types of muzzle launched projectiles, which employ a solid payload mass forward of the bullet trap, a more conventional approach is still required to safely launch from a rifle with a standard soft-core and steel-core rifle bullet. In addition, the bullet trap configuration must be inexpensive to fabricate and assemble, and must maximize the internal tube length available to place over the rifle muzzle.

Recently, an additional operational requirement has developed, which further stresses conventional bullet trap design. It has been observed during extensive testing that occasionally a bullet fragment or bullet trap particle can escape rearward from the projectile launch tube, once the projectile has cleared the rifle muzzle. This is a common, largely unpredictable, and potentially hazardous condition, which is not easily or consistently solved by modifying the soft aluminum plug material or shape.

The solution to this problem is to incorporate a resilient rubber gasket supported within the launch tube before the soft aluminum plug. This gasket, if properly affixed within the tube, is pierced by the bullet, yet re-seals, retaining all bullet and bullet trap fragments down stream in the bullet trap. Such an approach has been proposed in several U.S. Pat. Nos. in particular 3,664,263 (Driscoll), 3,726,036 (Jennings et al.), and 5,349,906 (Devaux et al.). However, the level of complexity and questionable performance of these inventions make them of little practical use for many muzzle launched projectile applications, such as within the muzzle launched grapnel hook, and with a variety of rifle bullets employing both soft lead fillers and hardened steel core components. Some of these bullet traps employ many complicated to manufacture subcomponents, within a complex machined projectile tube, requiring numerous boring, reaming, and threading operations, in order to accurately fit the bullet trap components within the projectile tube. Some teach that the bullet trap components are placed within the tube from the front of the projectile—the opposite end from which the bullet enters—which adds additional costs, since this separate tube must then be affixed to the payload.

It is also doubtful whether the rubber gasket these bullet traps will function as intended, once the gasket has been pierced by the bullet, and the bullet trap becomes pressurized. Understanding that a certain amount of gas pressure follows the bullet through the gasket into the bullet trap, at some point during projectile travel off of the rifle muzzle, the gas pressure within the bullet trap will greatly exceed that within the projectile tube. The bullet trap is also highly pressurized, since it is initially exposed to the high muzzle pressures, which can approach 10,000 psi. Due to adiabatic expansion, the pressure within the tube will drop dramatically with every inch of projectile travel, down to a low point of perhaps 500 psi when the projectile finally leaves the rifle muzzle. At this point the gasket will re-open, permitting pressurization to violently escape rearward out of the bullet trap, along with bullet and bullet trap fragments. Since prior designs do not provide an adequate means to resist this negative pressure against the gasket, the intent of the gasket to retain bullet fragments is not achieved.

In light of these shortcomings in the approaches proposed in the prior art, we have greatly improved upon the concept of sealing the bullet trap and have invented a much simplified, yet more reliable configuration, employing a fragment-sealing rubber gasket and only three inexpensive to machine bullet trap components. This self-contained bullet trap unit is then simply dropped into the back of the projectile launch tube, fabricated with one inexpensive boring operation, followed by one simple reaming operation. Our much simplified bullet trap approach provides results unanticipated by the prior art, within a simplified and inexpensive to manufacture configuration, providing heretofore unrealized advantages to-bullet trap and muzzle launched projectile performance.

SUMMARY

Accordingly, several objects and advantages of our invention are to provide a fragment-sealing bullet trap which overcomes the problems set forth in detail herein above.

The bullet trap assembly of this invention is made up of a projectile launch tube, which slides over the muzzle of a standard rifle or rifle muzzle adaptor. The rear opening of this launch tube is of a uniform internal diameter of sufficient depth to accommodate the length of the fragment-sealing bullet trap, when inserted through the rear opening, plus the length of the barrel muzzle over which the projectile launch tube will be placed prior to firing. This depth is approximately seven inches. For ease of manufacturing, the internal diameter of the launch tube is bored the entire depth with a drill, and then reamed for final dimension. As a result, the base of this hole retains the drill bit head angle, which is approximately 120 degrees for standard drill bits. Retaining this angle at the base of the hole eliminates the need for an end milling operation, normally required when using prior bullet trap configurations. In addition, this angular base contributes to the strength of the launch tube, and the integral functioning of the bullet trap anvil, when stopping hardened steel-core bullets.

Into this angled base region of the launch tube is placed a hardened steel anvil. The front surface of this anvil is cut to match the drill bit head angle used to bore the launch tube hole. As such, the anvil fully conforms to the bottom of the launch tube. In the back of the anvil, a small hole is bored to a depth about equal to the hole diameter. This hole is also bored with a drill bit and retains the angled bottom of the drill bit head.

Into this hole in the anvil is place the fragment-sealing aluminum bullet trap. This bullet trap is the assembly of a screw on cap, a resilient gasket, and an aluminum alloy plug. The screw on cap has an outside diameter which permits it to slide into the launch tube, with a few thousandths of an inch clearance. It is then retained in the tube with a press on o-ring. The rear face of the cap has a center line through-hole, sized to permit the full diameter of the incoming bullet to pass without interference, but small enough to retain the gasket under the high gas pressure which will be captured within the bullet trap.

On the forward side of the cap bulkhead wall, a resilient gasket is located, followed by a section of threads. These threads affix the cap to the aluminum alloy plug, which completes the bullet trap assembly. Although a threaded connection is the easiest to design and analyze for reliable strength, alternative connections are possible, which may further reduce the cost of the assembly. A shrink fit, press fit, or pinned connection, with or without an adhesive may work just as well, and may be advantageous depending on other manufacturing considerations.

The aluminum alloy plug has a rear face which is tapered inward to permit the gasket to expand forward as the bullet perforates it. This taper is sufficient to permit expansion of the gasket, resulting in the bullet making a small hole through the center, without dislodging the gasket or causing it to fracture catastrophically. The resiliency of the rubber gasket is such that the gasket will stretch over the diameter of the bullet, permitting its entire length to pass through without permanently expanding the small hole made by the bullet. After the bullet passes, the gasket rebounds, sealing the small hole. Depending on the nose shape of bullets to be fired into the bullet trap, a pin-size hole may be pre-made in the gasket to ensure proper functioning. However, with standard military rifle bullets, this is unnecessary, since the bullet tip is adequately sharp to form its own small starter hole.

The central cylindrical region of the plug has a reduced diameter to permit the softer bullet material to expand and decelerate, without cracking the launch tube. The front portion of the plug has a reduced diameter cylindrical section, which fits within the steel anvil. This reduced diameter section has a diameter smaller than the opening in the anvil, permitting the plug section to expand during bullet impact. This expansion absorbs bullet impact shock, thus reducing the peak accelerations, to which the entire projectile is subjected.

The aluminum bullet trap plug, therefore, provides four distinct and complex functions, within one simple component. The center region of the plug provides the advantage of stopping and retaining the soft bullet components. The front region provides a shock absorbing piston, which crushes during bullet impact, and also contributes to bullet fragment absorption. The rear face of the plug provides a cavity permitting the limited expansion of the re-sealing gasket during bullet penetration, thus ensuring that the gasket neither rips, dislodges, nor has its center completely sheared out by the full diameter of the bullet. Finally, the outside rear portion of the plug provides a surface for attaching and retaining the cap, which retains the gasket under the high internal gas pressure, which will develop inside the bullet trap.

Unlike the present series of bullet traps, this invention affixes the resilient fragment-sealing gasket and its retaining cap directly to the bullet absorbing aluminum plug, thus minimizing the depth to the bullet trap. This invention also incorporates the shock absorbing feature of the bullet trap as an integral part of the function of the aluminum plug, again reducing bullet trap length, and complexity, and making the entire bullet trap function at greater efficiency for its weight and depth. This invention also tapers the inside and outside bulkhead surfaces of the steel anvil to maximize its hard-core bullet retention strength, while minimizing the anvil weight, and simplifying both anvil and launch tube machining operations. This combination of features has heretofore never been undertaken and successfully achieved in fragment-sealing bullet trap design.

It is an object of this invention to provide a fragment-sealing bullet trap, which incorporates therein a resilient gasket to retain bullet and bullet trap fragments from exiting rearward out of the launch tube.

It is still another objective of this invention to provide a fragment-sealing bullet trap, which incorporates therein a soft aluminum plug for retention of soft bullet components, and integral to this aluminum plug is a shock absorbing piston, when deemed necessary to mitigate peak launch accelerations.

It is still another objective of this invention to provide a fragment-sealing bullet trap, which incorporates therein a hardened steel anvil for retention of hard bullet components.

It is still another objective of this invention to provide a fragment-sealing bullet trap, which minimizes the required length of bullet trap components, thus maximizing the internal launch tube length available to accelerate the projectile to high launch velocity.

It is still another objective of this invention to provide a fragment-sealing bullet trap, which incorporates therein features which minimize fabrication complexity.

These and other objects of the invention will be better understood by reference to the following detailed descriptions, accompanying drawings, and claims.

BRIEF DESCRIPTION OF THE DRAWINGS

The specification concludes with a claim particularly pointing out and distinctly claiming the subject matter of the present invention. However, it is believed that the invention will be better understood from the following description taken in connection with the accompanying drawings in which:

DESCRIPTION OF THE PREFERRED EMBODIMENTS

Figure 1:
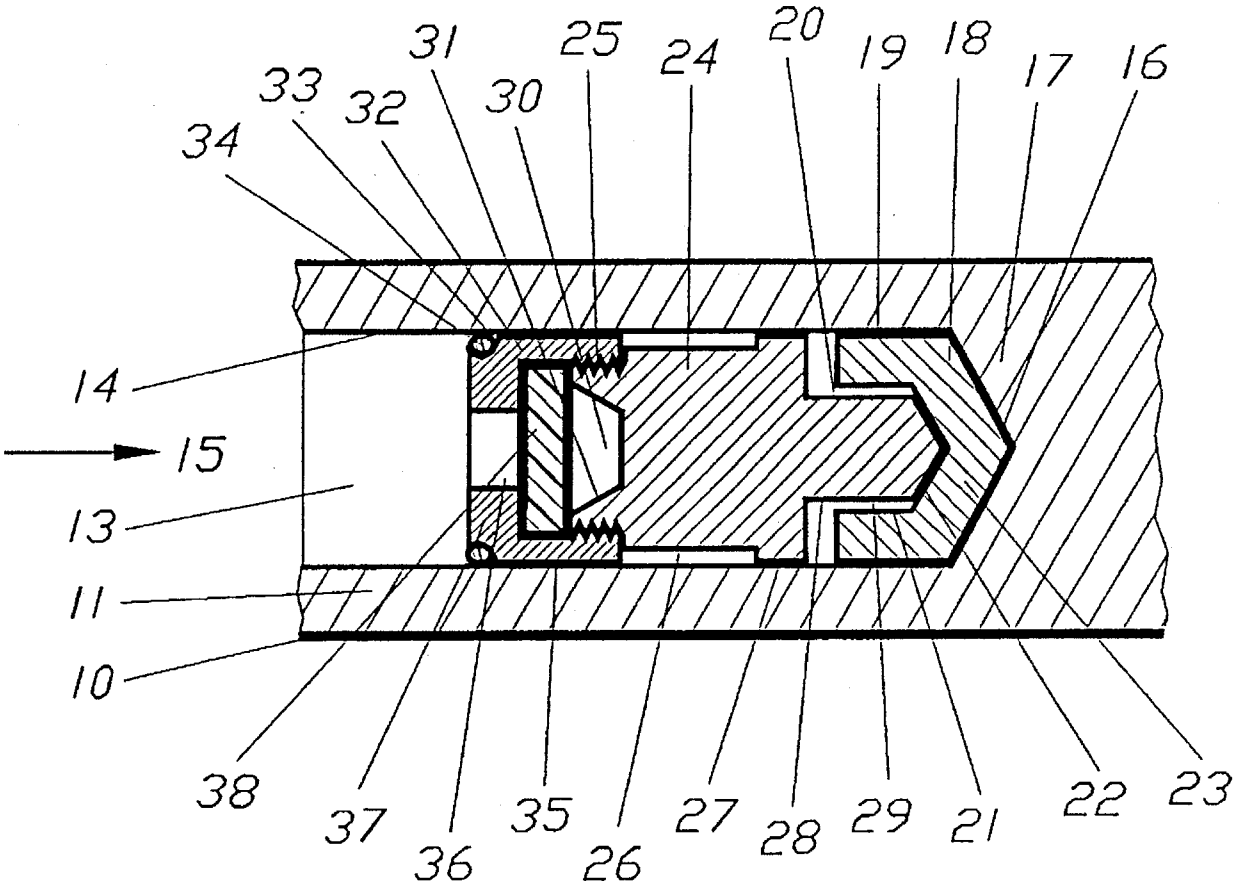
FIG. 1 is a cross-sectional view of one embodiment of the invention.

FIG. 1 shows a cross-sectional view of our invention, a fragment-sealing bullet trap assembly 10, providing an advantage not heretofore obtained with the present series of bullet traps. The major components or parts of this new bullet trap unit include the projectile launch tube 11, made of high strength material, such as aluminum alloy, fiber reinforced plastic composite, or steel, depending on the weight and trajectory range requirements of the payload. In this figure, the entire length of the launch tube is not shown, only that portion which contains the bullet trap components. With respect to travel direction 15, opening toward the rear of the launch tube is interior cavity 13. The interior cavity has a cylindrical surface 14 of substantially uniform diameter along its entire cylindrical length. The diameter of this interior cylindrical surface is sized to fit over the muzzle of a rifle, with a few thousandths of an inch tolerance. The cylindrical surface is followed by tapered surface 16. This tapered surface defines an internal bulkhead 17 within the launch tube. Forward of this bulkhead is affixed the projectile payload, not shown.

Placed within the internal cavity of the launch tube is steel anvil 18, made of high strength steel alloy. The anvil has a cylindrical exterior surface 19 of diameter slightly smaller than the diameter of the internal cavity. With respect to the travel direction, the front external surface of the anvil is tapered to match the tapered internal surface of the launch tube cavity. Opening toward the rear of the anvil is an interior cavity 20. This interior cavity has a uniform cylindrical surface 21, followed by a tapered surface 22. This tapered surface defines an internal bulkhead 23 within the anvil.

Placed inside the internal cavity of the launch tube and partially within the internal cavity of the anvil is aluminum plug 24. The longitudinal exterior surface of the plug is defined by threaded surface 25, followed by lesser diameter cylindrical surface 26, full diameter shoulder surface 27, and lesser diameter piston surface 28. The threaded surface is of sufficient length and thread pitch to provide at least four complete threads. Lesser diameter cylindrical surface 26 is of a diameter and length sufficient to permit the plug to absorb the volume of the impacting bullet, without expanding beyond the internal diameter of the launch tube. Full diameter shoulder surface 27 is of diameter a few thousandths of an inch below that of the launch tube internal diameter, but greater than the lesser diameter cylindrical surface, and provides stability to the plug within the launch tube as it deforms under bullet impact. The shoulder length needs to be approximately two tenths of an inch. Lesser diameter piston surface 28 is of diameter approximately one tenth of an inch less than the diameter of the internal cavity in the anvil. The difference in these two diameters defines piston gap 29, which closes as the piston crushes, absorbing bullet impact energy, and mitigating shock accelerations. The piston front surface is tapered to match the internal bulkhead taper of the anvil. At the plug rear surface is plug internal cavity 30, defined by tapered internal surface 31. The depth of the plug internal cavity should be approximately the diameter of the bullet.

Attached to the rear of the plug by means of the threaded surface is cap 32. The longitudinal external surface of the cap is defined by o-ring groove 33, in which is placed o-ring 34, which holds the entire bullet trap assembly tightly in place in the launch tube prior to firing. Following the o-ring is a cylindrical surface 35. This cylindrical surface is of diameter a few thousandths of an inch below the diameter of the launch tube interior cavity, and provides additional shoulder stability to the cap and plug assembly within the launch tube during bullet impact. The longitudinal distance between the two shoulder regions of the bullet trap assembly, defined by cylindrical surfaces 27 and 35, establish a greater shoulder wheel base length for enhanced stability to the bullet trap assembly as it deforms under bullet impact. It is important to have this long wheel base between the cap and plug riding the inner wall of the launch tube. It prevents the bullet trap assembly from cocking during bullet penetration and plug and piston crush-up. Should the plug cock within the launch tube and anvil, the bullet and any steel core within will begin to take the path of least resistance, which will be towards the side of the plug and into the launch tube wall, rather than along the line of fire and into the anvil. Both the rear shoulder surface on the cap and the front shoulder surface on the plug are necessary to ensure adequate in-tube stability for the plug, to prevent this type of failure of the bullet trap.

The few thousandths of an inch tolerance on the diameter between the cap exterior surface and the launch tube interior surface also ensures that the cap threads will not over-expand during bullet trap pressurization and possibly slide radially off of the plug. The launch tube cavity provides a positive stop to any radial movement of the cap, after the bullet has entered the plug, further enhancing the strength of the threaded connection in this fragment-sealing bullet trap design.

In the rear surface of the cap is through-hole 36 of diameter slightly larger than the diameter of the bullet to be fired into the bullet trap. The material adjacent to the through-hole defines a cap bulkhead 37. Following the through-hole is a larger diameter internal cavity in which solid cylindrical gasket 38 is placed. This gasket is made from a resilient material such as neopropylene (neoprene) rubber, polyurethane, butyl rubber, nitrile rubber (Buna N), or another elastomer with hardness from approximately 30 Shore A to approximately 70 Shore D. Forward of the gasket is a threaded surface for affixing the cap to the plug. The cap is made of high strength aluminum alloy.

The gasket should be sized to fit within the cylindrical void between the cap bulkhead and the rear surface of the plug with compression. In other words, the gasket should not be loosely dropped into this cavity, and screwing on the cap should provide some longitudinal compression to the gasket. This press fit to the gasket provides additional retention friction during gasket deformation due to bullet passage, and during the high pressurization of the bullet trap. In addition, radial compression of the gasket within the cap provides impetus for the gasket material to tightly re-seal the small hole made by the bullet, a very important consideration not found in the present series of fragment-sealing bullet trap designs. We find that forty-five thousandths of an inch interference fit between the gasket diameter and the cap interior cavity results in very tight re-sealing of the small hole. For example, a neoprene gasket made with a 0.625 inch diameter punch should be placed within a cap which has an interior cavity diameter cut to approximately 0.580 inches. Although the precise range of interference tolerances for various gasket materials and gasket diameters can vary, we have established that a loosely fit gasket—one placed within the cap without a press fit—will still be retained within the cap, and the hole made by the bullet will contract due to the resiliency of the gasket material. However, the small hole is not completely collapsed, and a small particle could still escape under high pressure. The best practice, therefore, is to ensure that the gasket presses tightly into position within the cap, and that the cap is sufficiently stiff in the radial direction to prevent loosening of the gasket during bullet penetration, gasket rebound, and bullet trap pressurization. This second consideration means that the cap should be made of a reasonably strong aluminum alloy, such as 6061-T6 or 7075-T6, and that its radial section is on the order of one tenth of an inch thick.

Operation of the Invention

Figure 2:
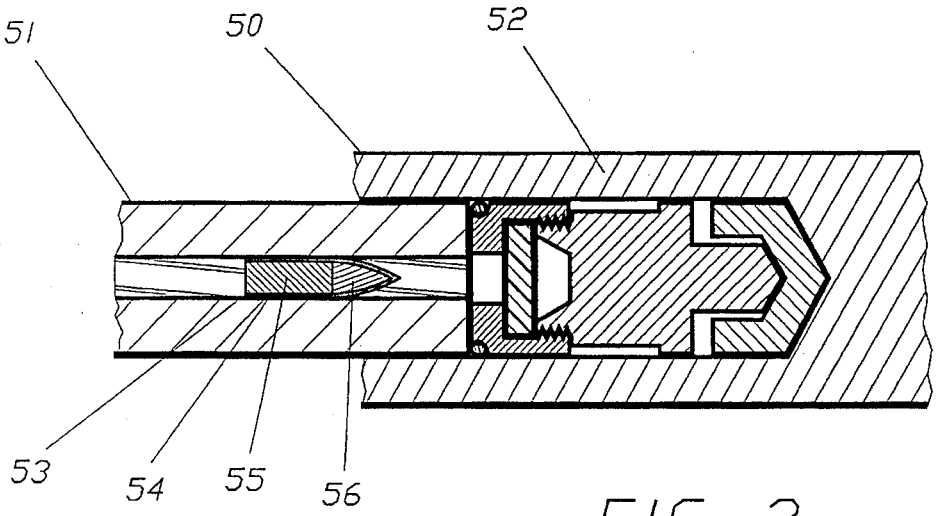
FIG. 2 is a cross-sectional view of one embodiment of the invention, when placed over the muzzle end of a rifle.

When the invention, a fragment-sealing bullet trap assembly 50, is placed over the muzzle end of a rifle 51, as shown in FIG. 2, the barrel opening is in close proximity with the rear surface of the bullet trap cap. FIG. 2 shows the rifle barrel completely inserted into launch tube 52. In this example, bullet 53 is comprised of bullet jacket 54, lead core 55, and hardened steel core 56.

Figure 3:
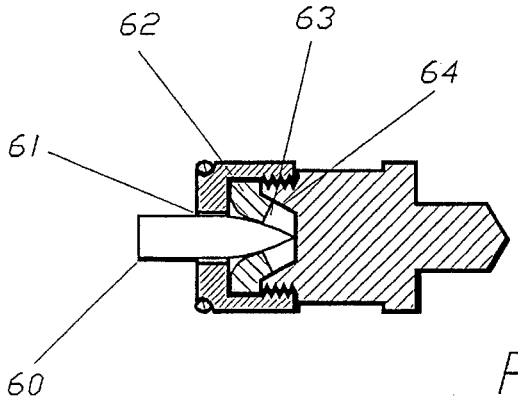
FIG. 3 is a cross-sectional view of one embodiment of the invention, demonstrating the function of the bullet trap cap, gasket, and plug, as the rifle bullet enters.

As shown in FIG. 3, bullet 60 exits the muzzle of the barrel and immediately begins to traverse through-hole 61 and penetrate fragment-sealing gasket 62. Due to the resiliency of the gasket material, the gasket will begin to resist penetration and deform forward into plug internal cavity 63, stopping its displacement upon reaching plug tapered surface 64. During this time, the point of the bullet makes a small hole in the gasket, of approximately one millimeter in diameter. Due to the forward displacement and stretching of the gasket into the plug internal cavity, this small hole will begin to stretch and widen, permitting passage of the entire diameter and length of the bullet, without tearing or ripping apart the gasket.

After passage of the bullet through the gasket, the gasket will remain slightly deformed and pressed against the rear tapered surface of the plug, due to the intense positive over pressure of the cartridge propellant gasses. The hole made in the gasket by the bullet will constrict due to the resilience of the gasket material, but it will not close completely, due to the intense over pressure forcing its way along in the direction of the bullet. The gasket will remain in this deformed position, until the gas pressure has equalized on both sides.

As the bullet traverses the gasket, it begins to penetrate the rear surface of the aluminum plug. The strength of the bullet jacket and any soft lead alloy filler material is insufficient to resist the strength and density of the aluminum plug. As a result, these soft bullet components begin to mushroom, expand, and decelerate within the central mass of the aluminum plug. The lesser diameter cylindrical surface of the plug will deform radially outward and expand to absorb the added volume of bullet material. The radial expansion of this surface will stop up against the internal surface of the launch tube. For this reason, the gap between the two surfaces is designed to accommodate the entire bullet volume so that excess expansion will not occur and crack or deform the launch tube. The combined length of these sections of the plug—the threaded section, lesser diameter cylindrical section, and the shoulder section—should be as long as the longest bullet to be fired into the bullet trap. For 5.56 mm rifles, the M855 bullet is the longest, at approximately 0.95 inches in length.

During this bullet deformation process within the central region of the plug, an impact shock compression wave is sent forward of the bullet along the length of the bullet trap. When this compressive wave reaches lesser diameter piston surface of the plug, the piston cross-section will begin to crush longitudinally and expand radially under compressive stresses greatly in excess of the rupture strength of the piston material section. The rupture strength of this piston section acts as a filter, limiting only the compressive shock stresses below the piston's rupture strength to be transmitted farther along the length of the bullet trap. In this manner, the piston limits the maximum launch acceleration shock transmitted up the launch tube and into the payload structure. The piston diameter continues to expand radially outward until it contacts the interior cavity surface of the anvil.

During the time this is occurring, if the bullet has a steel core element, this steel core has begun to penetrate through the softer bullet components, the central mass of the aluminum plug, and into the piston section of the plug. Since the aluminum alloy material of the plug is of insufficient strength and density, the steel core does not deform, but is only slowed down to some degree by the friction forces during this penetration process. As a result, the steel core enters the anvil region of the bullet trap with considerable kinetic energy and penetration capability.

With some steel core bullet designs, after separating from the bullet jacket and any remaining lead alloy filler, the steel core is dynamically unstable during the penetration of a relatively thick medium, such as aluminum. Dynamic instability means that the bullet gyroscopic restoring moment is less than the friction and drag over-turning moment acting forward of its center of gravity. Therefore, the trajectory of the steel core may begin to curve away from the center line of the aluminum plug. This is a potentially very hazardous condition, since the steel core may penetrate completely out of the side of the launch tube.

Figure 4:
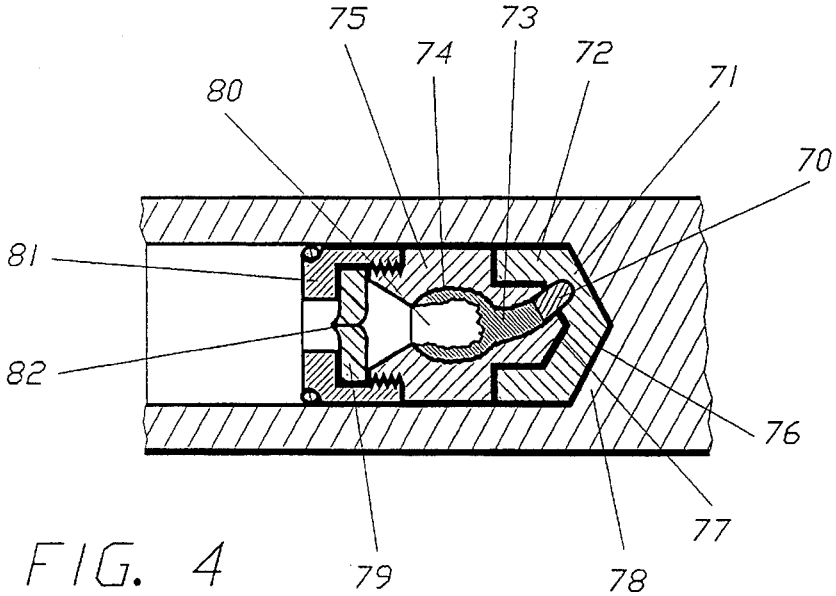
FIG. 4 is a cross-sectional view of one embodiment of the invention after it has deformed and absorbed the impact of a steel-core rifle bullet.

Within the bullet trap configuration of this invention, the central cylindrical region of the plug is no longer than the length of the bullet. A bullet is unlikely to change its direction within its own length. Therefore, any steel core trajectory curvature which may occur begins within the piston region of the plug. Since this piston region is now totally encapsulated within the volume of the anvil, due to the crushing activity preceding the arrival of the steel core, the steel core is safely captured, regardless of the direction of travel it may wish to assume. FIG. 4 shows the resulting internal configuration of the bullet trap after bullet impact and penetration. One sees the resulting location of hardened steel core 70 of the bullet, retained within bulkhead wall 71 of anvil 72. The other softer bullet components are smeared within region 73 of cavity 74 created inside aluminum plug 75.

Tapered cross-section 76 of the anvil, which is matched to the tapered cross-section of the internal bulkhead of the launch tube cavity greatly enhances the strength to weight performance of the anvil, as well. The tapering of internal cavity 77 of the anvil permits the steel core to be quickly captured close to the center line of the bullet trap, before it can deviate significantly in the radial direction, as shown in FIG. 4. Tapered bulkhead 78 of the launch tube provides significant backup material which is both lightweight and relatively strong, so that the steel anvil does not fail during bullet impact. The launch tube bulkhead may not in itself be strong and dense enough to withstand the penetration of the steel core, but this bulkhead is strong enough to prevent the hardened anvil from deforming radially under the impact of the steel core, which it can better resist, due to its strength and density. As a result, less steel is needed in the anvil, than if the anvil was fitted into the launch tube against a flat vertical bulkhead.

All of this crushing, expanding, and penetrating activity has occurred within a time scale of approximately one hundred microseconds. The projectile has perhaps displaced forward along the rifle barrel only one millimeter and has a velocity of less than ten meters per second. However, the bullet has been safely stopped in the launch tube, and the cartridge gas pressure can proceed to accelerate the projectile toward its target.

The muzzle gas pressures will follow the bullet through gasket 79 and into an expanded internal cavity 80 formed in the plug by the mushrooming bullet, as shown in FIG. 4. The pressurization will begin at the same level as the muzzle pressure when the bullet exited the barrel, approximately 10,000 psi. The gasket will relax from its extended position as the pressure within the plug equalizes with the pressure in the launch tube. As the projectile travels off of the rifle barrel, the volume within the launch tube that retains muzzle gas pressure begins to expand for every longitudinal unit of travel. As a result, the pressure in the launch tube steadily decreases. However, the pressure in the plug cavity remains constant, since its volume is not increasing. There is now positive pressure within the bullet trap that is being retained by the gasket, which is now fully relaxed and being pressed rearward up against cap bulkhead 81, as shown in FIG. 4. This high pressure will slowly leak out through a small hole 82 in the gasket, but not at the same rate as the pressure is dropping behind it in the launch tube. As a result, if the cap bulkhead is not strong enough, or the throughhole is too big, or the threaded surface is too weak, the gasket or its retaining cap can be blown out toward the rear of the launch tube, thus releasing high pressure and any bullet and plug fragments which are swept away with the pressure release. For these reasons, these features are sized and the materials are used as indicated in the drawings and specification.

Figure 5:
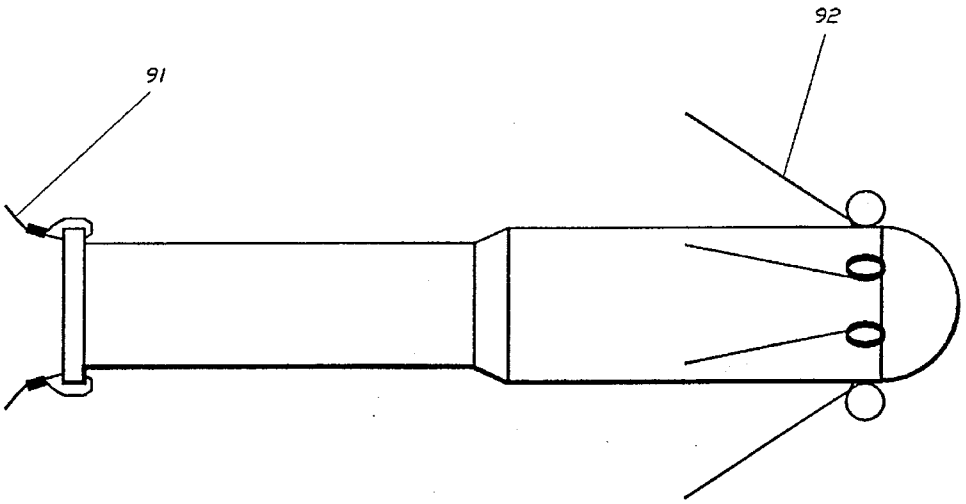
FIG. 5 PRIOR ART
FIG. 5 is an external view of one embodiment of the muzzle launched grapnel hook projectile.

The features of our invention and their functions are unique, significantly different from, and provide unanticipated advantages over the present series of bullet traps. As an example, only the features of our fragment-sealing bullet trap invention can be inexpensively and conveniently employed within the muzzle launched grapnel hook projectile. FIG. 5 shows an external view of one embodiment this projectile. The muzzle launched grapnel hook is a line throwing projectile, which pays out a retrieval line, attached to bridle assembly 91, that is used to pull the projectile back to the launch point. The head of the projectile incorporates torsion springs 92 as a means of detonating trip wire landmines, as the entire body is being pulled back. A complete description of the muzzle launched grapnel hook is found in U.S. Pat. No. 5,448,937 (Buc et al.).

Figure 6:
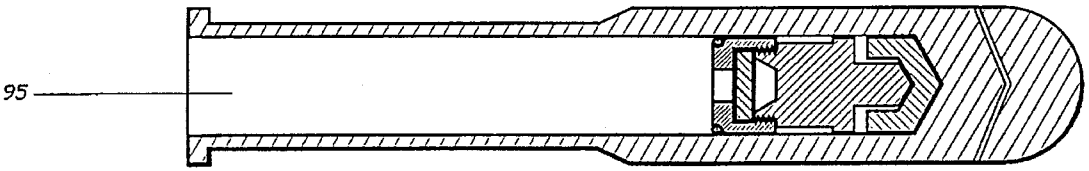
FIG. 6 is a cross-sectional view of one embodiment of the invention employed within one embodiment of the muzzle launched grapnel hook projectile.

FIG. 6 shows a cross-sectional view of the interior of the launch grapnel hook projectile employing our bullet trap invention. One sees that the only convenient means of installing a fragment-sealing bullet trap is through rear opening 95 of the launch tube. It is very expensive and impractical to install the fragment sealing gasket and bullet trap components from the front of this projectile, as taught by the prior art. One would have to machine a threaded connection to affix the payload mass, containing the torsion springs, and then machine complicated recesses within the tube to retain the gasket and bullet trap components. We have successfully eliminated these expensive and time consuming operations.

Our invention employs a self-contained bullet trap assembly, comprising a gasket containing cap screwed onto the threaded surface of the bullet trap plug. This assembly drops easily into the launch tube cavity from the rear to rest upon the anvil, similarly installed. All bullet trap components are then retained tightly in the launch tube through the use of an o-ring, again pressed on through the launch tube aft cavity.

Our fragment-sealing bullet trap employs two positive stops to prevent failure of the gasket during both bullet penetration and retention of pressurized gas and fragments within the bullet trap. Our bullet trap plug has a tapered rear surface and internal cavity which permits the gasket to expand and stretch just enough for the bullet to pierce a small hole and stretch its way through the gasket. Too much deformation in this direction and the gasket would completely dislodge or rip. Too little deformation in this direction and the gasket will rip or have its center sheared out by the full diameter of the bullet.

Following pressurization of the bullet trap, the gasket must be provided with a positive stop in the opposite direction to prevent the gasket from blowing back out. Our invention provides this unique feature in the structure of the cap, which contains the gasket and is attached to the bullet trap plug. This cap has a small through-hole in its bulkhead to permit the bullet to traverse and penetrate the gasket, but this through-hole is still small enough to prevent the gasket from being extruded back out under the high internal bullet trap pressure which will develop inside.

Our bullet trap invention employs shock absorbing features and a hardened steel anvil in a unique, compact, weight and space efficient design. The shock absorbing piston is integral to the bullet absorbing plug, thereby provided both features of shock absorption and bullet absorption, as it crushes to fill the internal cavity of the anvil. The anvil is designed with both an internal and external tapered front surface, providing a bulkhead which comes into quick contact with the steel-core portion of the bullet, which may deflect off of the shot line. The tapered surface of this bulkhead also takes full advantage of the strength and weight of the launch tube bulkhead, against which the anvil rests.

The reader will see that the fragment-sealing bullet trap of this invention provides a greatly improved gasket configuration, within a highly weight and length efficient bullet absorbing plug, shock absorbing piston, and steel-core absorbing anvil combination, providing improved performance, safety, and more cost-effective fabrication and assembly of rifle muzzle launched projectiles. This fragment sealing bullet trap may be efficiently employed within any type of muzzle launched projectile, which cannot accommodate a bullet-through type of bullet trap, and where the retention of bullet and bullet trap fragments is critical to ensuring the safety of the operator. The relative dimensions and sizes of the bullet trap components of our invention, such as the cap, gasket, plug, piston, and anvil, may vary depending on the caliber of the bullet and type of rifle being employed as the launch mechanism, and the associated variations in cartridge pressure, bullet mass and volume, and impact velocity and energy. The aluminum plug and cap materials may be of an aluminum alloy of greater or lesser strength, depending on the characteristics of the bullets being absorbed. It may also be advantageous to fabricate the plug component out of pure aluminum or another relatively soft metal alloy, such as magnesium, copper, brass, bronze, and lead. The cap could be made from material other than aluminum, so long as it provides adequate strength for the retention of the gasket under pressure. Steel could be used for the cap, but with a greater weight penalty than if aluminum is used. Magnesium alloy could be used to provide greater weight reduction than with aluminum. The type of rubber, resilience, hardness, and thickness of the gasket material may be varied depending on the muzzle gas pressures to which the bullet trap will be subjected, a function of the cartridge and rifle employed. The hardened steel anvil may be made of a high strength steel, either heat treated or cold worked, providing sufficient strength to retain the steel core components of candidate rifle cartridges. This normally requires a steel with an ultimate strength in the 100,000 to 200,000 psi range. The projectile launch tube does not need to be fabricated from the same homogenous piece of material from which the payload mass is fabricated. The launch tube may be fabricated separately and of different material, and affixed to the payload to accommodate the unique features of other payload options and projectile functions. The internal bulkhead at the end of the launch tube internal cavity may be placed at greater or lesser depth depending on the desired projectile launch velocity and recoil limitations of the projectile-rifle system. The inclusion of the anvil, with or without the shock absorbing feature of the aluminum plug is dictated by the characteristics of the rifle bullet, and the launch acceleration limits of the projectile and payload. A steel anvil may be omitted if only soft core bullets are being used. The anvil could also be made from a high compressive strength ceramic material, such as aluminum oxide, silicon carbide, or tungsten carbide. Ceramics provide greater compressive strength than most steels, and with the exception of tungsten carbide, ceramics are generally less dense than steel. Fabrication costs would be higher, but other structural and weight efficiency changes may compensate. The tapered bulkhead of the launch tube is an ideal geometry for the use of a ceramic anvil, since the thick launch tube bulkhead will provide excellent tensile containment of the ceramic anvil, as it provides for the steel anvil. The shock absorbing piston feature may be omitted if the projectile is very heavy, and hence less. susceptible to high acceleration shock or if it employs a very strong payload, where high peak accelerations can be safely tolerated. The piston section may or may not have to be integrally fabricated from the same piece of material as the plug. If there are advantages to be made, an alternative piston section could be inserted into the front of the plug section. In some circumstances, only the bullet trap cap, gasket and aluminum plug of this invention are sufficient to-achieve fragment sealing capabilities in a safe and efficient muzzle launched projectile configuration, depending on the class of rifle bullets to be trapped. There are many possible projectile and bullet applications which may employ slight variations of this bullet trap invention, or employ only a few critical combinations of features presented in this invention, such as the fragment-sealing gasket, retaining cap, and the plug to which it is attached.

We claim:

1. A fragment-sealing bullet trap for use in rifle muzzle launched projectiles, comprising:

a launch tube, a metallic cap, a gasket made of an elastomeric material, and a metallic plug;

said launch tube has an interior cavity opening rearward having a cylindrical longitudinal cross section having an internal diameter sized to fit over the muzzle end of a rifle;

said cap is affixed to an aft cylindrical exterior surface of said plug defining a bullet trap assembly; said bullet trap assembly is inserted into the rearward opening interior cavity of the launch tube;

said cap has an interior cavity opening forward having a substantially cylindrical longitudinal cross section having an internal diameter;

said gasket has a substantially cylindrical longitudinal cross section having an external diameter which is greater than said internal diameter of said cap;

said gasket is disposed within the interior cavity of the cap with a press fit, providing fragment-sealing means against the escape of bullet and plug fragments after perforation; and said plug has at its base an interior cavity opening rearward having a substantially frusto-conically tapered longitudinal cross section over substantially its entire length providing expansion volume for the gasket during bullet perforation said gasket is in contact with a base of said interior cavity of said cap and said base of said plug.

2. The fragment-sealing bullet trap in claim 1 wherein said plug has located at the front a cylindrical section of plug material providing shock absorbing means to mitigate the peak impact acceleration of the penetrating bullet.

3. The fragment-sealing bullet trap in claim 2 wherein said fragment-sealing bullet trap has an anvil; said anvil provides means for retaining the hard metallic components of rifle bullets; said anvil has an interior cavity opening toward the rear; said interior cavity of said anvil has a longitudinal cross section mating with the front of the plug; said anvil is inserted into the rearward opening interior cavity of the launch tube and located forward of the plug; said anvil is made from materials selected from the group consisting of steels and ceramics.

4. The fragment-sealing bullet trap in claim 1 wherein said gasket is made from an elastomeric material selected from the group consisting of neopropylene rubber, polyurethane, butyl rubber, and nitrile rubber.

5. The fragment-sealing bullet trap in claim 1 wherein said plug is made from a material selected from the group consisting of pure aluminum, aluminum alloys, magnesium alloys, copper alloys, brass, bronze, and lead alloys.

6. The fragment-sealing bullet trap in claim 1 wherein said cap has a through-hole along a center line of a rear surface permitting passage of a bullet without making contact with the rear surface of the cap; said through-hole has an internal diameter less than the external diameter of the gasket; the cap along the radial distance between the internal diameter of said through-hole and the internal external diameter of the cap defines a cap bulkhead; said cap bulkhead provides aft support to the gasket following bullet perforation and bullet trap pressurization.

7. The fragment-sealing bullet trap in claim 1 wherein said cap has an o-ring disposed about the aft cylindrical exterior surface providing means for tightly retaining the bullet trap assembly within the launch tube interior cavity.

8. A fragment-sealing bullet trap for use in rifle muzzle launched projectiles, comprising:

a launch tube, a metallic cap, a gasket made of as elastomeric material, and a metallic plug;

said launch tube has an interior cavity opening rearward having a cylindrical longitudinal cross section having an internal diameter sized to fit over the muzzle end of a rifle;

said cap is affixed to an aft cylindrical exterior surface of said plug defining a bullet trap assembly; said bullet trap assembly is inserted into the rearward opening interior cavity of the launch tube;

said cap has an interior cavity opening forward having a substantially cylindrical longitudinal cross section having an internal diameter;

said gasket has a substantially cylindrical longitudinal cross section having an external diameter which is greater than said internal diameter of said cap;

said gasket is disposed within the interior cavity of the cap with a press fit, providing fragment-sealing means against the escape of bullet and plug fragments after perforation;

said plug has at its base an interior cavity opening rearward having a substantially frusto-conically tapered longitudinal cross section over substantially its entire length providing expansion volume for the gasket during bullet perforation, said gasket is in contact with a base of said interior cavity of said cap and said base of said plug;

said cap has an external surface having a diameter slightly smaller than the internal diameter of said launch tube; said cap external surface defines an aft shoulder surface for the bullet trap assembly when placed inside the launch tube;

said plug has an external surface having a diameter slightly smaller than the internal diameter of said launch tube; said plug external surface defines a forward shoulder surface for the bullet trap assembly when placed inside the launch tube; and said aft and said forward shoulder surfaces provide lateral stability to the bullet trap assembly within the launch tube during bullet impact, penetration, and deformation.

9. The fragment-sealing bullet trap in claim 8 wherein said plug has located at the front a cylindrical section of plug material providing shock absorbing means to mitigate the peak impact acceleration of the penetrating bullet.

10. The fragment-sealing bullet trap in claim 9 wherein said fragment-sealing bullet trap has an anvil; said anvil provides means for retaining the hard metallic components of rifle bullets; said anvil has an interior cavity opening toward the rear; said interior cavity of said anvil has a longitudinal cross section mating with of the front of the plug; said anvil is inserted into the rearward opening interior cavity of the launch tube and located forward of the plug; said anvil is made from materials selected from the group consisting of steels and ceramics.

11. The fragment-sealing bullet trap in claim 8 wherein said gasket is made from an elastomeric material selected from the group consisting of neopropylene rubber, polyurethane, butyl rubber, and nitrile rubber.

12. The fragment-sealing bullet trap in claim 8 wherein said plug is made from a material selected from the group consisting of pure aluminum, aluminum alloys, magnesium alloys, copper alloys, brass, bronze, and lead alloys.

13. The fragment-sealing bullet trap in claim 8 wherein said cap has a through-hole along a center line of a rear surface permitting passage of a bullet without making contact with the rear surface of the cap; said through-hole has an internal diameter less than the external diameter of the gasket; the cap along the radial distance between the internal diameter of said through-hole and the internal diameter of the caps defines a cap bulkhead; said cap bulkhead provides aft support to the gasket following bullet perforation and bullet trap pressurization.

14. The fragment-sealing bullet trap in claim 8 wherein said cap has an o-ring disposed about the aft cylindrical exterior surface providing means for tightly retaining the bullet trap assembly within the launch tube interior cavity.

15. A fragment-sealing bullet trap for use in rifle muzzle launched projectiles, comprising:

a launch tube, a metallic cap, a gasket made of an elastomeric material, and a metallic plug;

said launch tube has an interior cavity opening rearward having a cylindrical longitudinal cross section having an internal diameter sized to fit over the muzzle end of a rifle;

said cap is affixed to an aft cylindrical exterior surface of said plug defining a bullet trap assembly; said bullet trap assembly is inserted into the rearward opening interior cavity of the launch tube;

said cap has an interior cavity opening forward having a substantially cylindrical longitudinal cross section having an internal diameter;

said gasket has a substantially cylindrical longitudinal cross section having an external diameter which is greater than said internal diameter of said cap;

said gasket is disposed within the interior cavity of the cap with a press fit, providing fragment-sealing means against the escape of bullet and plug fragments after perforation;

said plug has at its base an interior cavity opening rearward having a substantially frusto-conically tapered longitudinal cross section over substantially its entire length providing expansion volume for the gasket during bullet perforation said gasket is in contact with a base of said interior cavity of said cap and said base of said plug;

said cap has an external surface having a diameter slightly smaller than the internal diameter of said launch tube; said cap external surface defines an aft shoulder surface for the bullet trap assembly when placed inside the launch tube;

said plug has an external surface having a diameter slightly smaller than the internal diameter of said launch tube; said plug external surface defines a forward shoulder surface for the bullet trap assembly when placed inside the launch tube;

said aft and said forward shoulder surfaces provide lateral stability to the bullet trap assembly within the launch tube during bullet impact, penetration, and deformation;

said plug has a central cylindrical section located between said aft and said forward shoulder surfaces; said central cylindrical section having an external diameter less than the internal diameter of the launch tube interior cavity, defining a gap; said gap providing expansion volume for said central cylindrical section when absorbing the volume of the penetrating bullet;

and said plug has located at the front a cylindrical section of plug material providing shock absorbing means to mitigate the peak impact acceleration of the penetrating bullet.

16. The fragment-sealing bullet trap in claim 15 wherein said fragment-sealing bullet trap has an anvil; said anvil provides means for retaining the hard metallic components of rifle bullets; said anvil has an interior cavity opening toward the rear; said interior cavity of said anvil has a cylindrical longitudinal cross section; said anvil is inserted into the rearward opening interior cavity of the launch tube and located forward of the plug; the front of the plug is inserted inside the rearward opening interior cavity of the anvil; said anvil is made from materials selected from the group consisting of steels and ceramics.

17. The fragment-sealing bullet trap in claim 15 wherein said gasket is made from an elastomeric material selected from the group consisting of neopropylene rubber, polyurethane, butyl rubber, and nitrile rubber.

18. The fragment-sealing bullet trap in claim 15 wherein said plug is made from a material selected from the group consisting of pure aluminum, aluminum alloys, magnesium alloys, copper alloys, brass, bronze, and lead alloys.

19. The fragment-sealing bullet trap in claim 15 wherein said cap has a through-hole along a center line of a rear surface permitting passage of a bullet without making contact with the rear surface of the cap; said through-hole has an internal diameter less than the external diameter of the gasket; the cap along the radial distance between the internal diameter of said through-hole and the internal diameter of the gap defines a cap bulkhead; said cap bulkhead provides aft support to the gasket following bullet perforation and bullet trap pressurization.

20. The fragment-sealing bullet trap in claim 15 wherein said cap has an o-ring disposed about the aft cylindrical exterior surface providing means for tightly retaining the bullet trap assembly within the launch tube interior cavity.

* * * * *